United States Patent [19]

Takenoya et al.

[11] Patent Number: 4,538,932

[45] Date of Patent: Sep. 3, 1985

[54] WIRE-DOT IMPACT TYPE PRINTER

[75] Inventors: Hideaki Takenoya; Fumiyuki Mishima, both of Tokyo, Japan

[73] Assignee: Janome Sewing Machine Industry Co., Ltd., Japan

[21] Appl. No.: 623,683

[22] Filed: Jun. 22, 1984

[30] Foreign Application Priority Data

Jun. 22, 1983 [JP] Japan ..... 58-94966[U]

[51] Int. Cl.[3] ..... B41J 11/057; B41J 23/34

[52] U.S. Cl. ..... 400/185; 400/470; 400/616.2; 400/649; 400/662

[58] Field of Search ..... 400/124, 185, 470–471.1, 400/649, 616–616.3, 662

[56] References Cited

U.S. PATENT DOCUMENTS

| | | | |
|---|---|---|---|
| 4,210,917 | 7/1980 | Lane | 400/470 X |
| 4,376,585 | 3/1983 | Fromme et al. | 400/185 |
| 4,386,861 | 6/1983 | Kurihara et al. | 400/470 X |

FOREIGN PATENT DOCUMENTS

| | | | |
|---|---|---|---|
| 188388 | 11/1982 | Japan | 400/185 |

*Primary Examiner*—Paul T. Sewell
*Attorney, Agent, or Firm*—William A. Drucker

[57] ABSTRACT

In a wire-dot impact type printer, a single electric motor is employed for rotating a platen provided at a periphery thereof with a plurality of ink saturated members to thereby change a color to be applied to a printing paper, as well as for rotating tractors cooperated with feed rollers to thereby transport the printing paper in a predetermined direction. A transmission mechanism for transmitting rotational movement of the motor to the tractors comprises a switch disc rotated together with the motor and having a circular periphery thereof which is half toothed and half untoothed, and a clutch composed of a first rotating disc rotated due to engagement with the toothed half portion of the switch disc and a second rotating disc capable of rotating together with the first rotating disc being rotated in one direction to thereby cause the tractors to rotate for the paper feeding operation, but prevented from rotation when the first rotating unit is rotated in the opposite direction. The platen is rotatable in both directions by the reversible motor while the switch disc is positioned such that the first rotating disc of the clutch confronts the untoothed half portion of the switch and is not in mesh with the toothed half portion, which makes the tractors inoperative so that the printing paper remains standstill.

4 Claims, 2 Drawing Figures

WIRE-DOT IMPACT TYPE PRINTER

BACKGROUND OF THE INVENTION

This invention relates to a wire-dot impact type printer in general, and more particularly to a drive control mechanism of a wire-dot impact type color printer.

There has been proposed a printer of a type wherein a printing paper is passed between a printing head and a platen having a plurality of sintered members saturated with different color inks mounted on the periphery thereof, and the paper is pressed against a selective one of the ink saturated members by means of wires in the printing head, so that a color print may be effected on the paper. According to the prior art, an electric motor or the like driving source has been employed to rotate the platen to thereby select a desired one of colors to be applied to the paper, in addition to two motors used for transporting the printing paper and the printing head respectively, resulting in increase in the size of the printer itself, as well as in complexity of the individual drive motors.

In this connection we have already proposed to use a one-way rotation clutch as a transmission component of the drive mechanism of the printer so that the control for feeding the paper is established by an electric motor being rotated in one direction while the platen is driven by the same motor being rotated in the opposite direction to effect the color changing operation. This means that the single driving motor is employed for rotating the platen as well as for transporting the paper. However, the color changing operation will require the motor to be rotated in the opposite direction, different from the ordinary rotational direction during the printing operation. Thus, the color changing operation has been troublesome and time-consuming.

SUMMARY OF THE INVENTION

Accordingly, the present invention has been provided to eliminate defects and disadvantages of the prior art printer.

It is an object of the invention to provide a novel wire-dot impact type printer, simple in construction and easy to operate.

Another object of the invention is to provide a printer capable of effecting color changing operation smoothly and promptly, which is fully applicable to a colorfull print.

According to the invention there is provided a printer comprising a rotary platen provided on a periphery thereof a plurality of members saturated with different color inks; a printing head arranged opposite to the platen so as to cooperate with the platen to apply an ink of a specific color to a printing paper adapted to pass therebetween; first means for rotating the platen; second means for transporting the printing paper relative to the platen and the printing head; and drive means driven under a predetermined control to operate the first and second means through first and second transmission means respectively; wherein the second transmission means comprises switch means including a rotary member operatively connected to the drive means and rotated in one or the opposite direction in dependence upon the controlled drive movement of the drive means, the rotary member having gear teeth formed in a limited range on the periphery thereof, and clutch means provided between the switch means and the paper transporting means, the clutch means being operative to transmit the drive movement of the drive means to the paper transporting means when the gear teeth of the rotary member come to engage the clutch means while the rotary member is rotated in one direction, and being inoperative with respect to the paper transporting means when the rotary member is rotated in the opposite direction.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENT OF THE INVENTION

Figure 1:
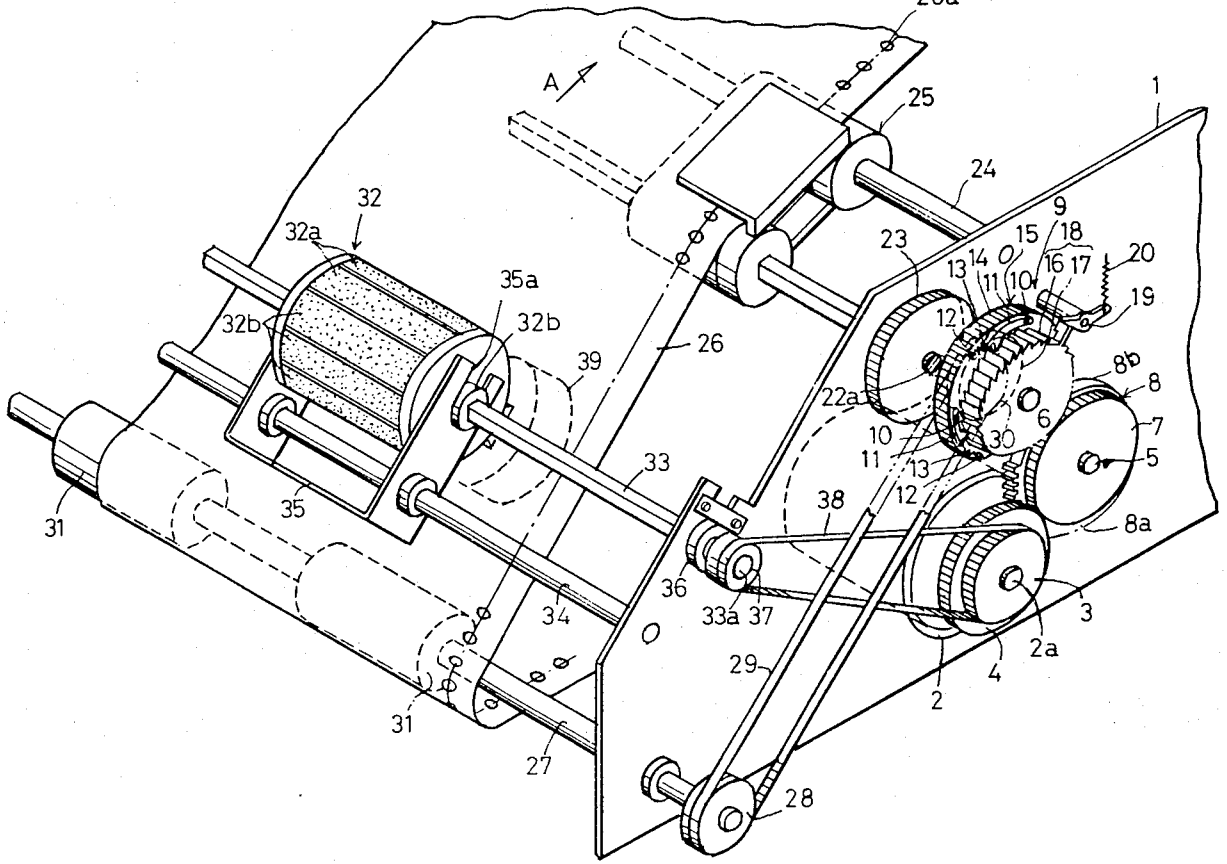
FIG. 1 is a perspective view diagrammatically showing a structure of principal elements of a printer embodying the invention.
Figure 2:
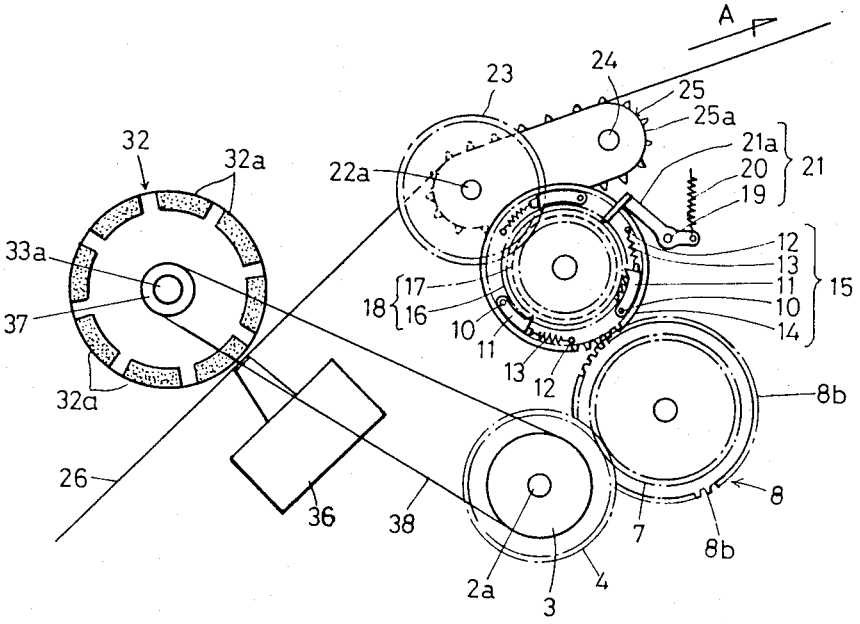
FIG. 2 is an explanatory view taken in the direction of the arrow B of FIG. 1.

A preferred embodiment of the invention will now be hereunder described in which directions of rotation and movement of respective parts are defined as being viewed from the right of FIG. 1.

In a printer, an electric motor 2 is secured to the inside of a frame 1. The motor 2 has a rotational shaft 2*a*, the end of which is protruded out of the frame 1 and is provided with a pulley 3 and a gear 4 coaxially mounted thereon. The numerals 5 and 6 denote pins arranged on the outside of the frame 1, respectively. The pin 5 provides a common axis for an intermediate gear 7 and a switch disc 8 to be rotated coaxially and together with each other. The intermediate gear 7 is in mesh with the gear 4 with a gear ratio of 1:1. The switch disc 8 has gear teeth 8*a* formed around a half part of the periphery thereof, the remaining half being left untoothed to be a smooth circular face. A one-way directional rotation clutch 9 is rotatably mounted on the fixed pin 6, which consists of a first rotating unit 15, a second rotating unit 18 and a stopper unit 21. More particularly, the first rotating unit 15 is composed of a gear 14 adapted to engage the gear teeth 8*a* of the switch disc 8 and a number of pawl members 11 provided on one side thereof each pivotable about a pin 10 and normally biased in one direction by a tension spring 13 having one end connected to the free end of the pawl member 11 and the other end anchored to a pin 12 planted on the side of the gear 14. The second rotating unit 18 is composed of a ratchet wheel 16 and a gear 17 which are coaxially and rotatably mounted on the pin 6 and separately rotatable from the first rotating unit 15. The stopper unit 21 is composed of a pawl member 21*a* which is turnable about a pin 19 mounted on the frame 1 and a tension spring 20 normally baising the pawl member 21*a* in a direction so that the pawl member 21*a* will come into engagement with the ratchet wheel 16 of the second rotating unit 18. Accordingly, when the first rotating unit 15 is rotated in the counterclockwise direction, the second rotating unit 18 is caused to rotate also in the counterclockwise direction due to the action of the pawl member 11 pressed against the teeth of the ratchet wheel 16, in which case the stopper 21 is turned in the direction away from the teeth of the ratchet wheel 16 and therfore made inoperative. On the contrary, when the first rotating member 15 is rotated in the clockwise direction, the pawl members 11 are brought out of engagement with the teeth of the ratchet wheel 16 against the action of the tension springs 13. Thus, the second rotating unit 18 will remain standstill irrespective of rotation of the first rotating unit 15, due to the action of the stopper 21 having the pawl 21*a* brought into engagement with one of the teeth of the ratchet wheel 16. In summary, the one-way rotation clutch 9 will function such that the rotational movement of the first rotating unit 15 in the counterclockwise direction is duly transmitted to the second rotating unit 18 to thereby cause the latter to rotate in the same direction, while the latter remains standstill when the former is rotated in the clockwise direction.

The switch disc 8 is rotated by an electric motor 2 via a motor shaft 2*a*, a gear 4 and the intermediate gear 7, so that the disc 8 may be rotated in a first range wherein the toothed part 8*a* is in mesh with the gear 14 to thereby transmit the rotation thereof to the latter for a paper feeding operation, and a second range wherein the untoothed part 8*b* is positioned to confront the gear 14 which then remains standstill when a color changing operation is made. These operation will be described later in detail.

A square shaft 22 is rotatably supported between a pair of vertical frames 1, though one of which is illustrated in FIG. 1. The end portion of the square shaft 22 is formed as a round shaft 22*a* which extends outside the frame 1 to be an axis of a gear 23 adapted to engage a gear 17 of the second rotating unit 18 of the clutch 9. Extending in parallel with the square shaft 22 is a guide shaft 24 rotatably mounted on the frame 1, and a pair of tractors 25 (only one of which is shown) for feeding a printing paper 26 are mounted on the shafts 22, 24 and are laterally displaceable with respect to the shafts 22, 24 in dependence upon the width of the paper 26. An endless belt 25*a* of each tractor 25 is rotated in the clockwise direction due to rotation of the square shaft 22. The endless belt 25*a* is provided with plurality of outwardly extending pins (not shown) which are engageable with holes 26*a* formed in the paper 26 along the edge thereof so as to feed the paper 26 in the direction of the arrow A.

A pair of feed rollers 31 are mounted on a shaft 27 which extends laterally and is rotatably supported on the panel 1. The shaft 27 has a pulley 28 secured to one end thereof on the outside of the frame 1 and connected to a puuley 30 by means of an endless belt 29. The pulley 30 is secured to the round shaft 22*a* so that the shaft 27 is rotated in accordance with rotation of the shaft 22 of the tractors 25. Although not shown, a pair of pinch rollers are arranged opposite to the feed rollers 31 respectively so that the paper 26 is adapted to pass therebetween to thereby run in the direction A. A cylindrical platen 32 is provided at the periphery thereof with a plurality of members 32*a* saturated with different color inks, each member being elongated in the axial direction of the platen 32. The platen 32 is mounted on a square shaft 33 and is slidable in the axial direction but is prevented from rotation relative to the shaft 33. There is provided a platen holder 35 for fixedly holding the platen 32 on both sides thereof. The holder 35 is mounted on a shaft 34 extending in parallel with the platen shaft 33 but is rotatable due to engagement between a recess 35*a* of the holder 35 and a boss 32*b* of the platen shaft 33. The platen shaft 33 extends to the outside of the frame 1 to provide a round shaft 33*a* at the end thereof, which is rotated by the motor 2 via pulley 37 and a belt 38. The numeral 36 denotes a bearing.

In this embodiment, the pulley 37 is so designed that the diameter thereof is ½ of that of the pulley 3, which means that the former makes two revolutions while the latter makes one revolution. In the meantime, as mentioned hereinbefore, the gear ratio of gears 4 and 7 is 1:1, and the periphery of the switch disc 8 rotated together with the gear 7 is divided into halves, one of which 8*a* is toothed to provide a first half area in which the paper feeding operation is carried out and the other of which 8*b* is untoothed to provide a second half area in which the color changing operation is effected. Consequently, due to the rotation of the motor shaft 2*a*, the platen 32 is rotated once while the switch disc 8 makes a half revolution within the second half area 8*b* for effecting the color changing operation, with the paper 26 being not transported.

The numeral 39 denotes a printing head arranged opposite to the platen 32, between which the paper 26 is adapted to pass so that the different color inks may be optionally applied to the paper 26.

The operation of the printer of the invention will now be described: At first, the color changing operation is generally required when a different color is to be printed on the paper in a continuous line. This is carried out by rotating the motor shaft 2*a* in one direction within the second half area 8*b* of the switch disc 8. In this angular area of the switch disc 8, the teeth 8*a* thereof are not in mesh with the gear 14, resulting in that the paper 26 is prevented from travelling and is kept standstill. Because a ½ revolution of the motor shaft 2*a* will be enough for making a complete one revolution of the platen 32, and because the platen 32 may be rotated in any one of directions, a desired one of the ink saturated members 32*a* may be selected easily and quickly. This will be advantageous especially when the color changing operation is frequently required in a continuous line, for producing a colorful design, for example.

Preferably, one of the ink saturated members 32*a* of platen 32 having a color (e.g., black) which is most frequently used is arranged to confront the printing head 39 when the central part of the untoothed half area 8*b* of the switch disc 8 confronts the gear 14, and other members 32*a* are arranged in the order of frequency of use.

Next, the paper feeding operation is carried out by rotating the motor shaft 2*a* in the counterclockwise direction. Thus, the switch disc 8 is rotated in the clockwise direction by way of gears 4 and 7, which results in that the gear 14 of the first rotating unit 15 of the one-way rotation clutch 9 is rotated in the counterclockwise direction due to engagement with the teeth 8*a* of the switch disc 8. Therefore, as described before, the gear 17 of the second rotating unit 18 is rotated in the counterclockwise direction together with the first rotating unit 15, and accordingly the gear 23 is rotated in the clockwise direction and further the pulley 28 is rotated in the same direction by way of the pulley 30 secured to the shaft 22*a*, thereby transporting the paper 26 in the direction A by cooperation of tractors 25 and feed rollers 31 which are rotated in the same direction, at the same revolution.

When it is required to change the color to be newly printed after the paper 26 has been transported, the motor shaft 2*a* is rotated in the clockwise direction. Thus, the switch disc 8 is rotated in the counterclockwise direction so that the teeth 8*a* thereof is disengaged from the gear 14. Then, the motor 2 is deenergized to stop when a desired one of the ink saturated members 32*a* is in a position confronting the printing head 39. In this control operation, the first rotating unit 15 of the clutch 9 would be rotated in the clockwise direction until the toothed portion 8*a* of the switch disc 8 is disengaged from the gear 14, but this rotational movement of the first rotating unit 15 is not transmitted to the second rotating unit 18 due to aforementioned function of the one-way rotation clutch 9, so that the paper 26 is prevented from travelling and remain stand- still.

While the invention has been described in conjunction with a specific embodiment thereof, it is to be noted that many different variations and modifications may be made without departing from spirit and scope of the invention.

What is claimed:

1. A printer comprising a rotary platen provided on a periphery thereof a plurality of members saturated with different color inks; a printing head arranged opposite to said platen so as to cooperate with said platen to apply an ink of a specific color to a printing paper adapted to pass therebetween; first means for rotating said platen; second means for transporting said printing paper relative to said platen and said printing head; and drive means driven under a predetermined control to operate said first and second means through first and second transmission means respectively; wherein said second transmission means comprises (a) switch means including a rotary member operatively connected to said drive means and rotated in one or the opposite direction in dependence upon the controlled drive movement of said drive means, said rotary member having gear teeth formed in a limited range on a periphery thereof, and (b) clutch means provided between said switch means and said paper transporting means, said clutch means being operative to transmit the drive movement of said drive means to said paper transporting means when said gear teeth of said rotary member come to engage said clutch means while said rotary member is rotated in one direction, and being inoperative with respect to said paper transporting means when said rotary member is rotated in the opposite direction.

2. The printer according to claim 1 wherein said clutch means comprises a first rotating member which may be engaged with said gear teeth of said rotary member to be rotated thereby, a second rotating member operatively connected to said first rotating member to transport the rotating movement of said first rotating member to said paper transporting means only when said first rotating member is rotated in one direction, and means for disconnecting said second rotating member from said first rotating member when said first rotating member is rotated in the opposite direction.

3. The printer according to claim 2 wherein said gear teeth are continuously provided on a half range of a periphery of said rotary member.

4. The printer according to claim 1 wherein said drive means is a reversible motor, and said platen rotating means is directly connected to said reversible motor.

* * * * *